US007172094B2

(12) United States Patent
Atsuta

(10) Patent No.: US 7,172,094 B2
(45) Date of Patent: Feb. 6, 2007

(54) PACKAGED GOODS DELIVERING DEVICE

(75) Inventor: Junichi Atsuta, Nagareyama (JP)

(73) Assignee: Tomy Company, Ltd., Tokyo (JP)

( * ) Notice: Subject to any disclaimer, the term of this patent is extended or adjusted under 35 U.S.C. 154(b) by 59 days.

(21) Appl. No.: 10/517,654

(22) PCT Filed: Jun. 30, 2003

(86) PCT No.: PCT/JP03/08290

§ 371 (c)(1),
(2), (4) Date: Dec. 13, 2004

(87) PCT Pub. No.: WO2004/003859

PCT Pub. Date: Jan. 8, 2004

(65) Prior Publication Data

US 2005/0252926 A1 Nov. 17, 2005

(30) Foreign Application Priority Data

Jul. 1, 2002 (JP) ..... 2002-192066

(51) Int. Cl.
*G07F 11/00* (2006.01)

(52) U.S. Cl. ..... 221/130; 221/131

(58) Field of Classification Search ..... 221/123, 221/124, 127, 130, 131, 132, 154, 155, 185, 221/197, 283, 282, 287; 211/49.1, 194
See application file for complete search history.

(56) References Cited

U.S. PATENT DOCUMENTS 3,223,245 A 12/1965 Weitzman
3,390,753 A * 7/1968 Bolen et al. ..... 221/284
4,423,827 A 1/1984 Guigan
4,722,577 A 2/1988 Mewborne
5,544,784 A * 8/1996 Malaspina ..... 221/135
5,607,085 A 3/1997 Cooper
5,713,550 A 2/1998 Schwarzli
5,947,328 A * 9/1999 Kovens et al. ..... 221/129
5,996,841 A * 12/1999 Marrocco ..... 221/268
6,119,892 A * 9/2000 Laurent et al. ..... 221/2
6,182,861 B1 2/2001 Kovens et al.
6,293,434 B1 9/2001 Ellis et al.

FOREIGN PATENT DOCUMENTS

JP 60-40807 3/1985

(Continued)

OTHER PUBLICATIONS

International Search Report for corresponding PCT/JP03/08290 dated Sep. 2, 2003.

(Continued)

*Primary Examiner*—Gene O. Crawford
*Assistant Examiner*—Timothy Waggoner
(74) *Attorney, Agent, or Firm*—Staas & Halsey LLP

(57) ABSTRACT

A packaged commodity dispensing device in which a package commodity dispensing machine is easily repaired and a packaged commodity is easily supplied and exchanged. The packaged commodity dispensing machine dispenses a packaged commodity; a frame into which the packaged commodity dispensing machine is permitted to detachably fit from forward; and a fixing section to fix the packaged commodity dispensing machine in a state of fitting into the frame.

7 Claims, 19 Drawing Sheets

FOREIGN PATENT DOCUMENTS

| | | |
|---|---|---|
| JP | 3-3077 | 1/1991 |
| JP | 6-59977 | 8/1994 |
| JP | 9-16832 | 1/1997 |
| JP | 2001-229441 | 8/2001 |
| WO | WO 95/13001 | 5/1995 |

OTHER PUBLICATIONS

International Search Report issued in corresponding PCT International Application No. PCT/JP2003/008290 (Corrected Version Apr. 28, 2005).

Supplementary European Search Report issued May 15, 2006 in corresponding European Patent Application No. EP 03 73 8592.

* cited by examiner (A)

(B)

(C)

(A)

(B)

(A)

(B)

(A)

(B)

(A)

(B)

(C)

PACKAGED GOODS DELIVERING DEVICE

CROSS REFERENCE TO RELATED APPLICATIONS

This application claims the benefit under 35 U.S.C. §§ 119 and 365 of PCT Application No. PCT/JP03/008290, filed Jun. 30, 2003, and Japanese Application No. 2002-192066, filed Jul. 1, 2002, which are hereby incorporated by reference in their entireties into this application.

BACKGROUND OF THE INVENTION

1. Field of the Invention

The present invention relates to a packaged commodity dispensing device for a dispensing packaged commodity.

In the specification, a "packaged commodity" is wide-ranging concept that includes not only a capsule commodity but also a commodity encapsulated in a container such as a box or the like and a commodity wrapped in paper.

2. Background Art

Earlier, for example, as a capsule commodity dispensing machine for dispensing a capsule commodity, one in which a rotation drum inside is rotated by turning a handle after inserting a coin, and a capsule commodity on the rotation drum is dispensed from a commodity dispense opening through a hole in the rotation drum and an opening under the rotation drum has been known. Such a capsule commodity dispensing machine is generally set up at a toy section or a landing of a department store, a game center, the inside of or outside the front of a convenience store, an amusement park or the like.

In this case, the capsule commodity dispensing machines are piled in two or three stages. When piling them, the capsule commodity dispensing machine is fixed just above the lower capsule commodity dispensing machine.

However, when piling the capsule commodity dispensing machines in multiple stages in the upper and lower direction, there is a problem of impairing the stability depending on the shape of the capsule commodity dispensing machine. On the other hand, when not piling the capsule commodity dispensing machines in multiple stages, there is a problem of decreasing space efficiency for setting up the capsule commodity dispensing machines.

Also, even when piling the capsule commodity dispensing machines in multiple stages, in the case of removing and repairing the capsule commodity dispensing machines in the middle excluding the capsule commodity dispensing machines in the highest and lowest stages, or replacing the capsule commodity dispensing machines in the middle, the work may become cumbersome. Further, the work to supply the capsule commodities into the capsule commodity dispensing machine or collecting the capsule commodities from the capsule commodity dispensing machine may become cumbersome.

SUMMARY OF THE INVENTION

The present invention is accomplished in view of the problems, and an object of the present invention is to provide a packaged commodity dispensing device in which a package commodity dispensing machine is easily repaired and a packaged commodity is easily supplied and exchanged.

In accordance witht he first aspect of the present invention, packaged commodity dispensing device comprises: a packaged commodity dispensing machine to dispense a package commodity; a frame into which the packaged commodity dispensing machine is detachably fit from the front, and a fixing section to fix the packaged commodity dispensing machinej in a state of fitting into the frame.

According to this packaged commodity dispensing device, since the packaged commodity dispensing machine can be attached to or detached from the frame, the packaged commodity dispensing machine can be taken out from the frame irrespective to the other packaged commodity dispensing machines. Thus, when taking out a desired packaged commodity dispensing machine, it is enough to release the fixation of the packaged commodity dispensing machine to the frame irrespective to the other packaged commodity dispensing machines. Also, since the fixing section to fix the packaged commodity dispensing machine in a state of fitting into the frame is provided, the packaged commodity dispensing machine can be fixed to the frame.

Perferably, in the device of the first aspect of the present invention, frames are permitted to be piled in an upper and lower direction, and a fixing section to fix the frames in a piled state is provided.

According to this capsule commodity dispensing device, since the frames are configured to be piled in the upper and lower direction, a large scale commodity shelf can be structured by piling the frames in the upper and lower direction and fitting the capsule commodity dispersing machines into the frames.

Perferably, in the device of the first aspect of the present invention, frames are permitted to be arranged in parallel in a lateral direction, and a fixing section to fix the frames in a state of being arranged in parallel is provided.

According to this packaged commodity dispensing device, since the frames are configured to be arranged in parallel in the lateral direction, a large scale commodity shelf can be structured by arranging the frames in parallel in the lateral direction and fitting the packaged commodity dispensing machines into the frames.

Perferably, in the device of the first aspect of the present invention, a commodity supply opening is formed in an upper surface of a case body of the packaged commodity dispensing machine.

According to this packaged commodity dispensing device, the packaged commodities can be supplied from the commodity supply opening of the case body of the packaged commodity dispensing machine by taking out the packaged commodity dispensing machine from the frame.

Perfereably, in the device of the first aspect of the present invention, the device (100) includes a commodity supply opening (20*a*) formed in an upper surface of the frame (20) from or to an inner space of the frame (20), the packaged commodity dispensing machine (10) is permitted to be inserted or removed through a forward inlet opening.

According to this packaged commodity dispensing device, since the commodity supply opening (20*a*) is formed in the upper surface of the frame (20), the packaged commodities (70) can be supplied from the packaged commodity supply opening (20*a*) without taking out the packaged commodity dispensing machine (10) through the forward inlet opening of the frame (20).

In the device of the first aspect of the present invention, the packaged commodity dispensing device may further comprise a commodity storing box which is permitted to directly be fixed to the frame, and a bottom plate of the packaged commodity storing case is permitted to be inserted or removed in a horizontal direction.

According to this packaged commodity dispensing device, since the commodity storing box which can directly be fixed on the frame is provided and the bottom plate of the commodity storing box is configured to be inserted or removed in the horizontal direction, the packaged commodities can easily be supplied by fixing the commodity storing box directly to the frame and removing the bottom plate.

In the device of the first aspect of the present invention, the packaged commodity dispensing device may further comprise a commodity display which is permitted to directly be fixed to the frame.

According to this packaged commodity dispensing device, since the commodity display which can directly be fixed on the frame is provided, the packaged commodities can be put in the commodity display to be displayed.

According to this packaged commodity dispensing device, since the commodity storing box which can detachably fit into the frame from the front is provided, the packaged commodities can easily be supplied by removing the bottom plate.

In the device of the first aspect of the present invention, the packaged commodity dispensing device may further comprise a commodity display which detachably fit into the frame from the front.

According to this packaged commodity dispensing device, the packaged commodities can be put in the commodity display to be displayed.

In the device of the first aspect of the present invention, the packaged commodity dispensing device may further comprise a base which is permitted to detachably be fixed to a bottom of the frame.

According to this packaged commodity dispensing device, since the base can be fixed to the bottom of the frame, the frame and thus the packaged commodity dispensing machine can be maintained at an appropriate height.

In the device of the first aspect of the present invention, the packaged commodity dispensing device may further comprise a clean box which is permitted to detachably fit into the frame. Further, in the device of the first aspect of the present invention, the base may be provided with a clean box.

According to this packaged commodity dispensing device, since the frame or the base is provided with the clean box, it is not required to separately provide a trash bin or the like.

Perferably, in the device of the first aspect of the present invention, at least a front wall of the packaged commodity dispensing machine is formed with a transparent material, and an arch shaped wall portion which protrudes forward is formed at a central portion of the front wall in a width direction.

According to this packaged commodity dispensing device, since the packaged commodities can be filled at the arch shaped wall portion, the packaged commodities can easily be recognized.

Preferably, in the device of the first aspect of the present invention, protruding pieces are formed inward at both ends of the arch shaped wall portion of the packaged commodity dispensing machine, and a partition plate which removably fits between joint portions of the protruding portions and the arch shaped wall portion is provided.

According to this packaged commodity dispensing device, since the space which is separated from the inside is formed between the partition plate and the arch shaped wall portion, samples or the like can be stored therein.

In the device of the first aspect of the present invention, the partition plate may be formed into a shape following an inner surface of the arch shaped wall portion.

According to this packaged commodity dispensing device, when there is no need to provide the space which is separated from the inside, the partition plate can be stored to be close to the arch shaped wall portion.

In the device of the first aspect of the present invention, the packaged commodity dispensing device may further comprise a display member which is inserted between the partition plate and the arch shape wall portion.

According to this packaged commodity dispensing device, when the partition plate is stored to be close to the arch shaped wall portion, a display member such as an advertisement or an instruction for use can be displayed therebetween. Also, when the direction of the partition plate is inverted to attach the display member, the packaged commodities are stored in the space formed therebetween, and the display member is moved along the rear surface (protruding side surface) of the partition plate to sandwich and hold the display member between the side edges of the partition plate and the protruding pieces. Thus, both of the commodity samples and the display member can be seen. The display member may be provided to be close to the front side surface of the partition plate, although the holding power would be reduced.

In the device of the first aspect of the present invention, the packaged commodity dispensing device may further comprise a shelf at a middle portion in a height direction of the partition plate.

According to this packaged commodity dispensing device, samples or the like can be displayed on the shelf.

Preferably, in the device of the first aspect of the present invention, at least the front wall and a side wall of the packaged commodity dispensing machine are formed with a transparent material, and a corner at which the front wall meets the side wall is formed into a curved surface.

According to this packaged commodity dispensing device, even when the packaged commodity dispensing machine is stored in the frame, the packaged commodities inside can be seen.

In the device of the first aspect of the present invention, an inspection hole may be formed in a rear surface of the frame.

According to this packaged commodity dispensing device, residual packaged commodities or the like in the packaged commodity dispensing machine can be checked even from the rear surface side of the frame.

BRIEF DESCRIPTION OF THE DRAWINGS

The present invention will become more fully understood from the detailed description given hereinafter and the accompanying drawings, however, these are not intended as a definition of the limits of the present invention, and wherein;

FIG. 6 are perspective views of a base in the capsule commodity dispensing device in FIG. 1, wherein FIGS. 6(A), 6(B) and 6(C) are perspective views of the base each showing a different mode;

FIG. 7 are front views of a commodity storing box in the capsule commodity dispensing device in FIG. 1, wherein FIGS. 7(A) and 7(B) are front views of the commodity storing box each showing a different mode;

FIG. 8 are front views of a commodity display in the capsule commodity dispensing device in FIG. 1, wherein FIGS. 8(A) and 8(B) are front views of the commodity storing box each showing a different mode;

FIG. 14 are perspective views showing one mode of a display part in the capsule commodity dispensing device in FIG. 12, wherein FIG. 14(A) is a perspective view of a state where a partition plate is not inserted, and FIG. 14(B) is a perspective view of a state where the partition plate is inserted;

FIG. 16 are perspective views showing another mode of the display part in the capsule commodity dispensing device in FIG. 12, wherein FIG. 16(A) is a perspective view of a state where the partition plate is not inserted, and FIG. 16(B) is a perspective view of a state where the partition plate is inserted;

FIG. 21 are perspective views of a base in the capsule commodity dispensing device in FIG. 12, wherein FIGS. 21(A), 21(B) and 21(C) are perspective views of the base each showing a different mode.

DETAILED DESCRIPTION OF THE EMBODIMENTS

First Embodiment

1. Whole Configuration of Capsule Commodity Dispensing Device

Figure 1:
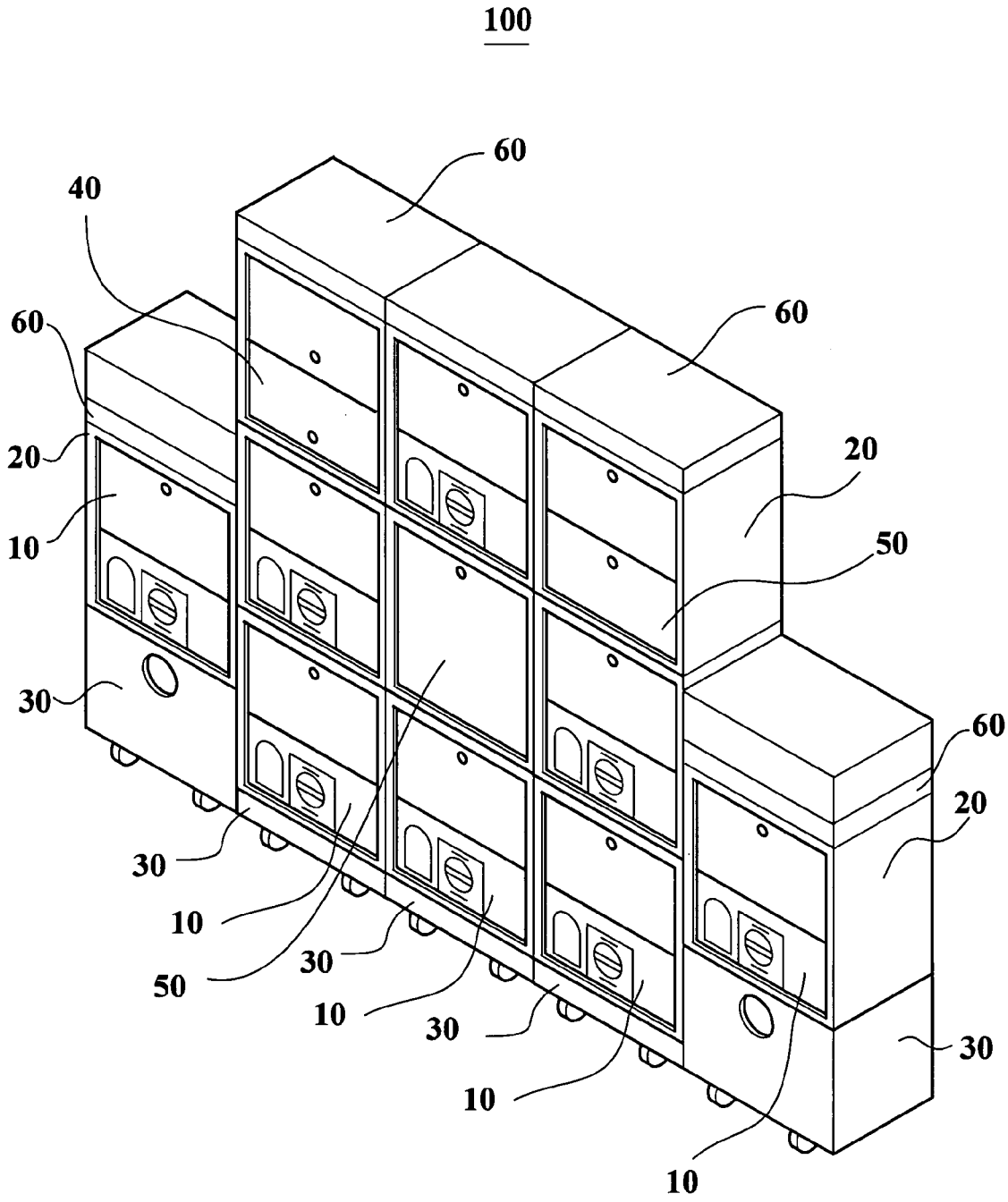
FIG. 1 is a perspective view of a capsule commodity dispensing device according to the first embodiment.

A capsule commodity dispensing device 100 of the embodiment, which is one of the packaged commodity devices, comprises a capsule commodity dispensing machine 10, a frame 20, a base 30, a commodity storing box 40, a commodity display 50 and a cover 60 as shown in FIG. 1.

2. Configuration of Capsule Commodity Dispensing Machine

Figure 2:
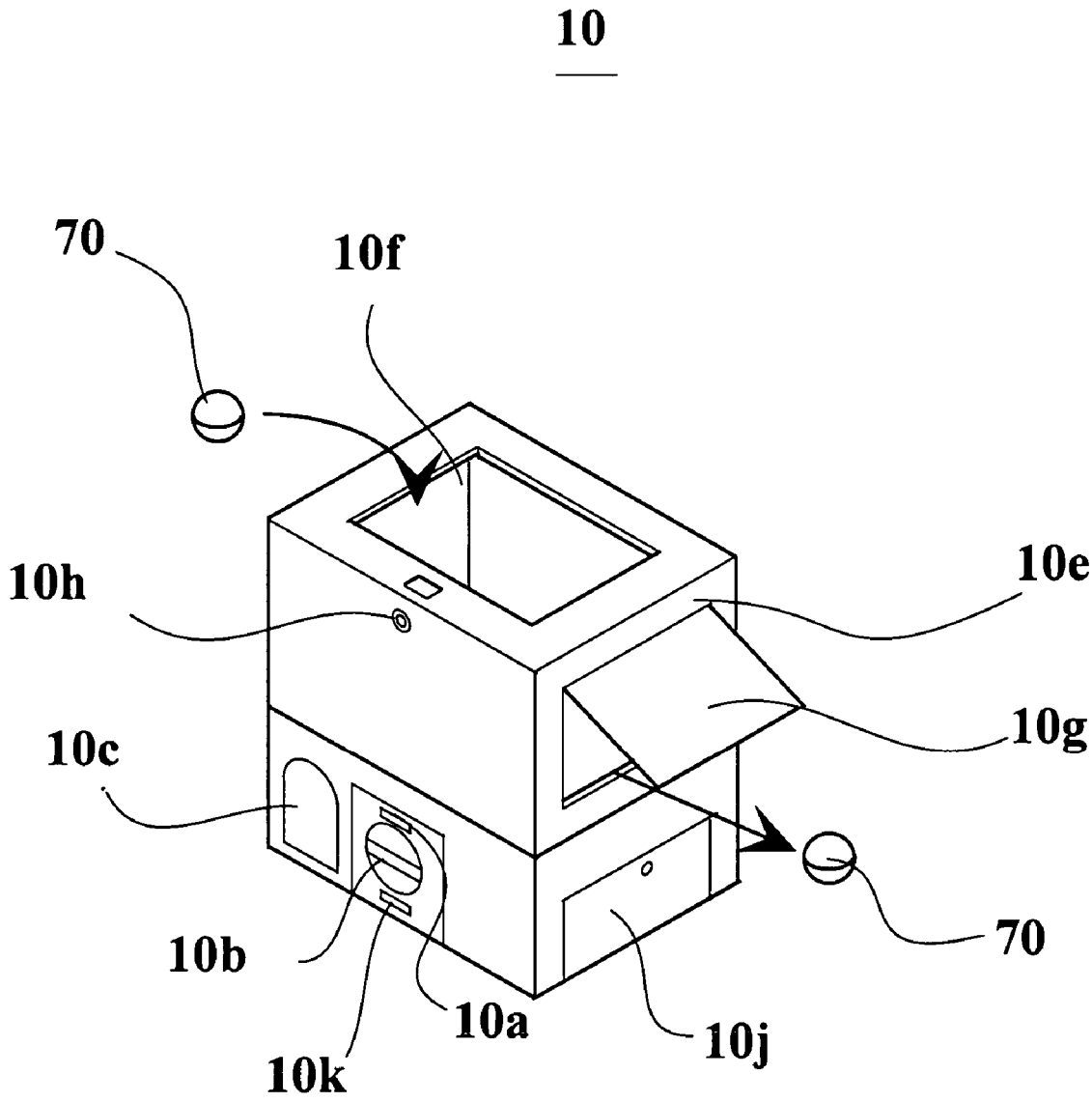
FIG. 2 is a perspective view of a capsule commodity dispensing machine in the capsule commodity dispensing device in FIG. 1.

The capsule commodity dispensing machine 10 is formed into a box shape as shown in FIG. 2. However, it is not limited to the box shape. This capsule commodity dispensing machine 10 is configured such that a capsule commodity 70 stored in a case body 10*e* is dispensed from a commodity dispense opening 10*c* by a customer turning a handle 10*b* after inserting a coin into a coin slot 10*a* on the front surface. Here, a coin is inserted into the coin slot 10*a*, however, the configuration may be such that a deposit card, a cash card or a credit card is inserted.

In the case body 10*e* forming the upper structure of the capsule commodity dispensing machine 10, many capsule commodities 70 can be received. When the capsule of the capsule commodity 70 is opened, there is a figure or other toy inside.

The capsule commodities 70 are supplied into the case body 10*e* from a commodity supply opening 10*f* provided in the upper surface of the case body 10*e*. On the other hand, removal of the capsule commodities 70 can be performed by opening a door 10*g* provided on the side surface of the case body 10*e*.

Figure 3:
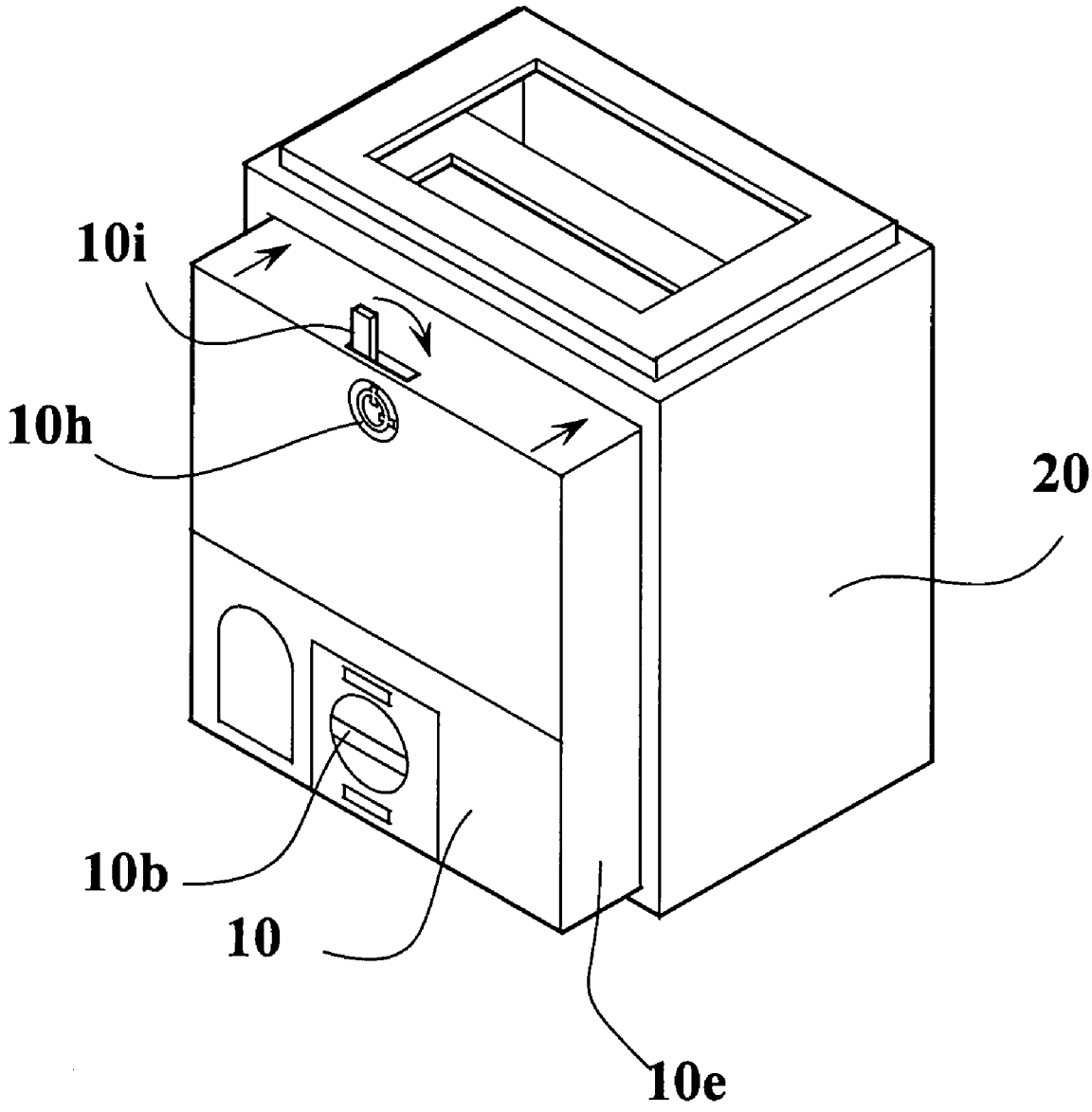
FIG. 3 is a perspective view of the capsule commodity dispensing machine and a frame in the capsule commodity dispensing device in FIG. 1.

Also, as shown in FIG. 3, a key cylinder 10*h* is provided on the front surface of the case body 10*e*. A projecting piece 10*i* is projected by inserting a key which is not shown into the key cylinder 10*h* and turning it. When the projecting piece 10*i* is in a projecting state, it engages with a hole of the frame 20 which is not shown, thereby fixing the capsule commodity dispensing machine 10 to the frame 20.

A mechanical portion forming the lower structure of the capsule commodity dispensing machine 10 is provided with a coin sorting device, and a rotation drum which rotates with the rotation of the handle 10*b* or the like, although they are not shown.

As shown in FIG. 2, the mechanical portion is provided with a cash box 10*j* on the side portion and a coin return 10*k* on the front surface.

3. Configuration of Frame 20

Figure 4:
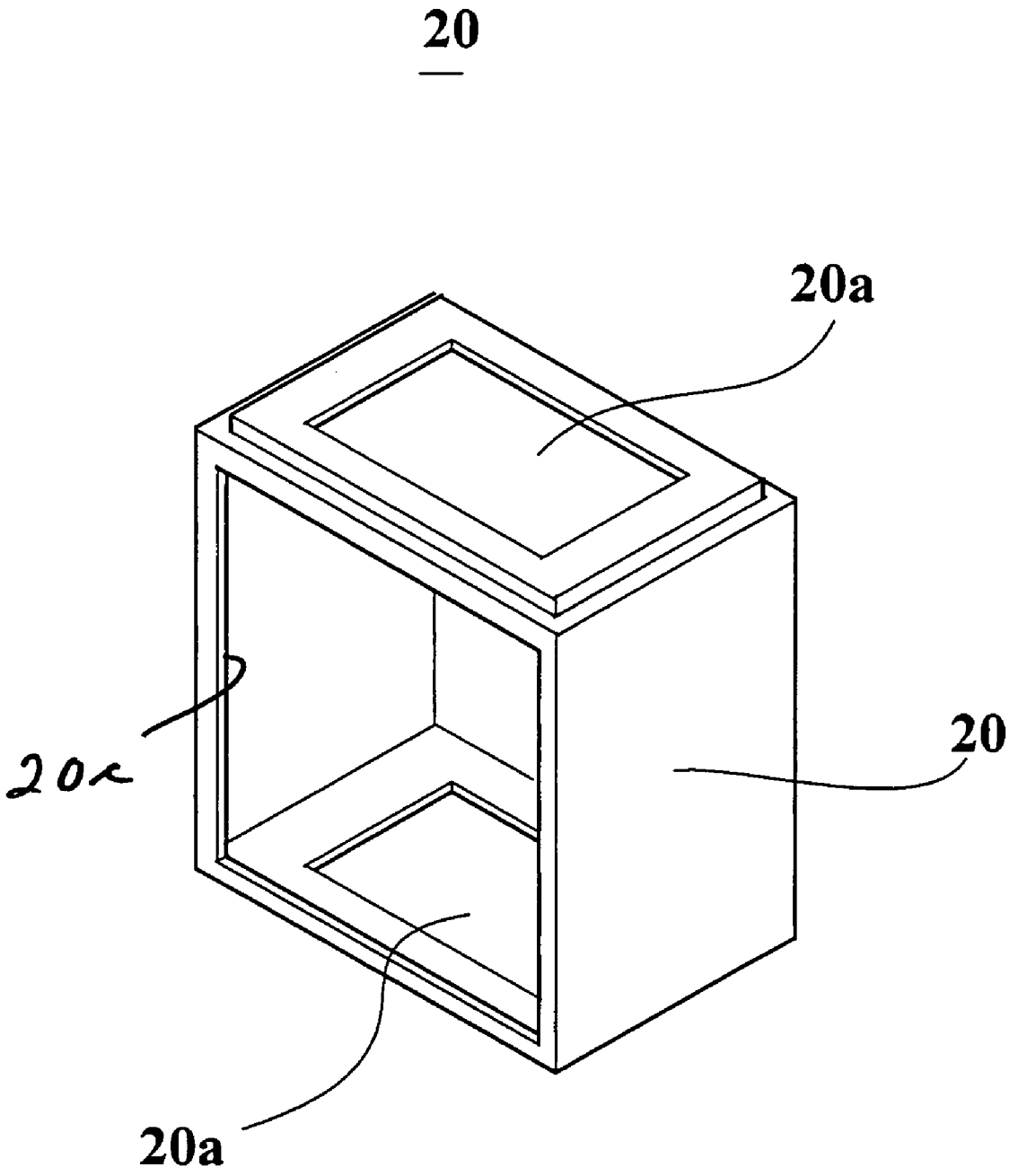
FIG. 4 is a perspective view of the frame in the capsule commodity dispensing device in FIG. 1.
Figure 5:
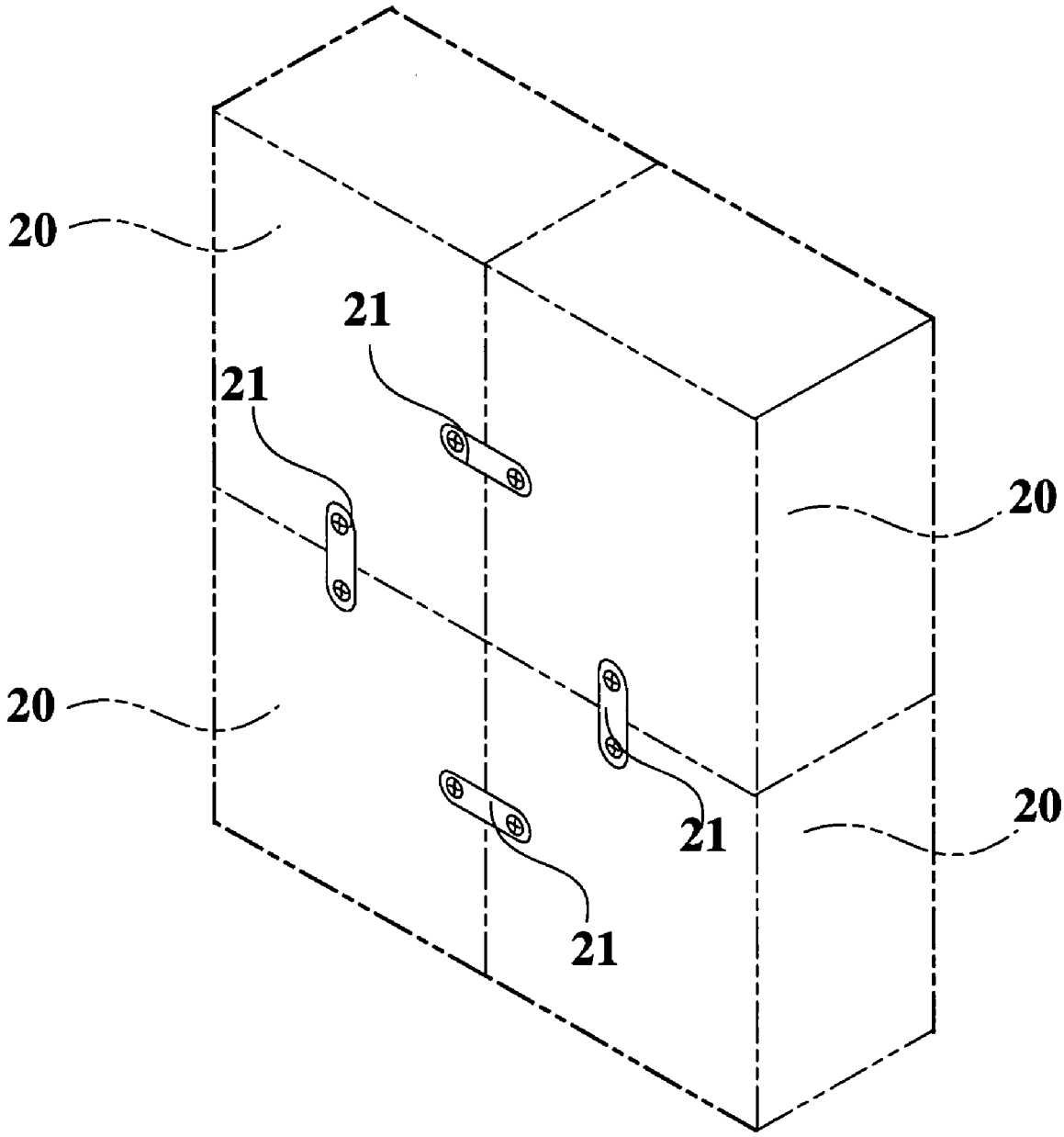
FIG. 5 is a view showing a connection structure of the frames in the capsule commodity dispensing device in FIG. 1.

The frame 20 is formed into a box shape, although it is not specifically limited. The capsule commodity dispensing machine 10 can fit into the frame 20 via an opening 20*c* in a front of the frame 20. The frame 20 is configured such that the capsule commodity dispensing machine 10 can be covered excluding the front surface thereof. In the upper surface and the lower surface of the frame 20, as shown in FIG. 4, commodity supply openings 20*a* are formed to correspond to the commodity supply opening 10*f* of the capsule commodity dispensing machine 10.

The frames 20 can be piled in the upper and lower direction, and can be arranged in parallel in a lateral direction. Fixation of the adjacent frames is performed by using a connection plate 21 to cross over between the frames 20 on the rear surface side and be screwed shut, although it is not specifically limited thereto.

4. Configuration of Base 30

Figure 6:
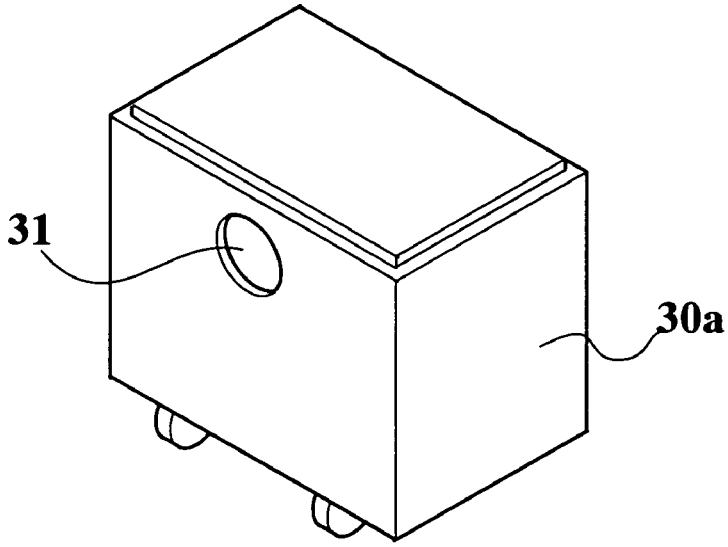
Figure 6:
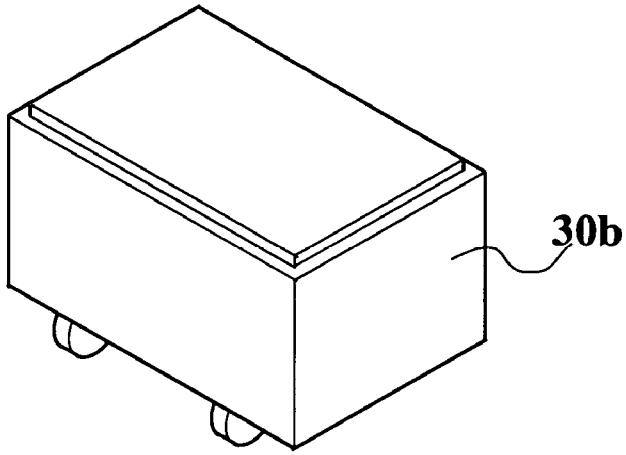
Figure 6:
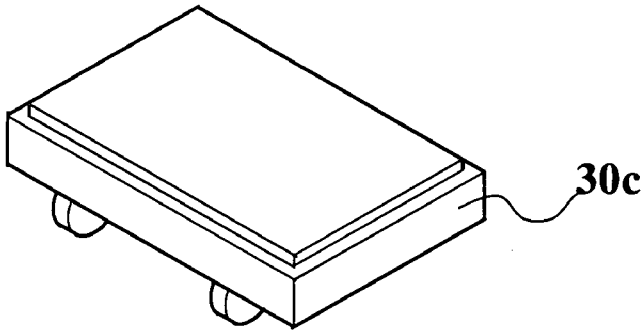

As the base 30 on which the frame 20 is set, three types of bases with a caster are prepared, although it is not specifically limited thereto. The first one is a base 30*a* with a clean box (FIG. 6(A), the second one is a standard base 30*b* (FIG. 6(B), and the third one is a slim base 30*c* (FIG. 6(C). Among them, the base 30*a* with the clean box is for putting trash, such as leftover capsules, and comprises a capsule slot 31. The capsules which were put in can be taken out from a door which is not shown.

The connection structure of the base 30 and the frame 20 is the same as the connection structure of the frames 20, although it is not limited thereto.

5. Configuration of Commodity Storing Box 40

Figure 7:
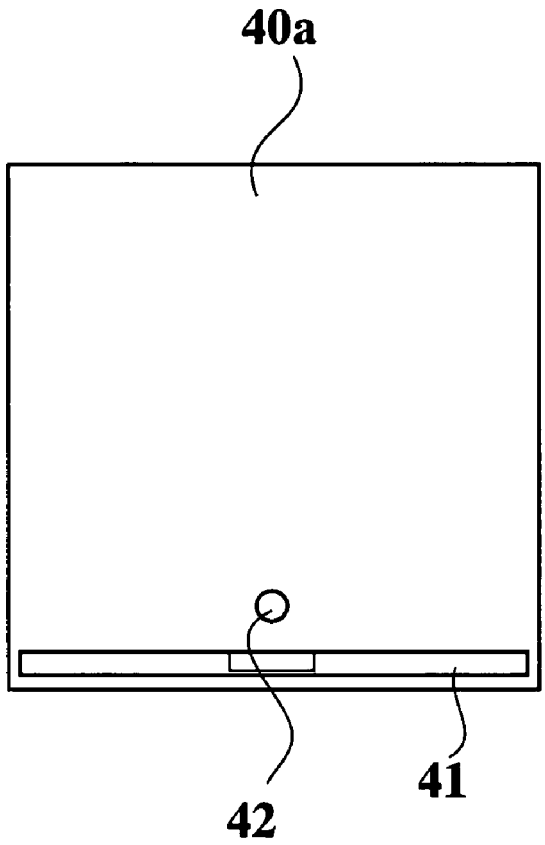
Figure 7:
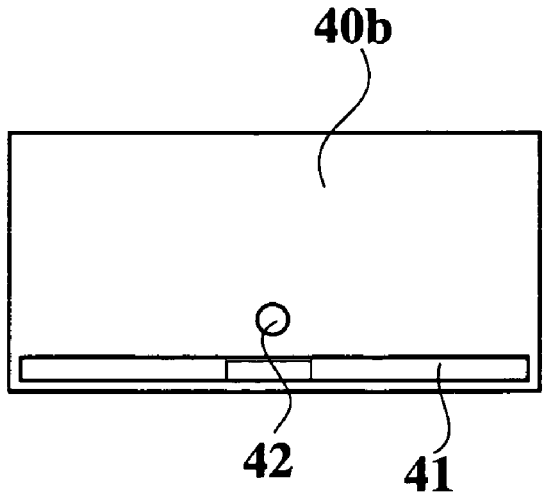

As the commodity storing box 40, two types of commodity storing cases are prepared as shown in FIGS. 7(A) and 7(B), although it is not limited thereto. The first one is a deep commodity storing box 40*a*, and the second one is a shallow commodity storing box 40*b*. The commodity storing box 40 can fit into the frame 20 from a front of the frame. In this case, only one deep commodity storing box 40*a* can fit into the frame 20, and two shallow commodity storing boxes can fit into the frame 20 at the upper and lower portions thereof at the same time.

A bottom plate 41 of the commodity storing box 40 can be inserted and removed from the front. Accordingly, when the commodity storing box 40 fits into the frame 20 in a state of storing the capsule commodity into the commodity storing box 40 and the bottom plate 41 is removed, the capsule commodities 70 are supplied into the capsule commodity dispensing machine 10 through the commodity supply openings 10*f*, 20*a*.

Further, a key cylinder 42 is provided on the front surface of the commodity storing box 40. A projecting piece which is not shown is projected by inserting a key which is not shown into the key cylinder 42 and turning it. When the projecting piece is in a projecting state, it engages with a hole of the frame 20 which is not shown, thereby fixing the commodity storing box 40 to the frame 20 or the like. It is preferable to provide the key cylinder 42 of the commodity storing box 40 on the lower side of the commodity storing box 40 so that the bottom plate 41 is also fixed by the projecting piece at the same time.

6. Configuration of Commodity Display 50

Figure 8:
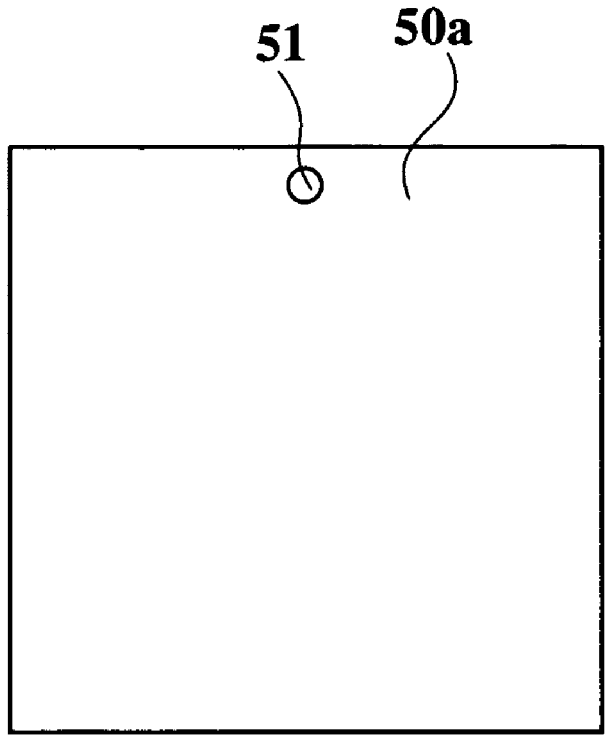
Figure 8:
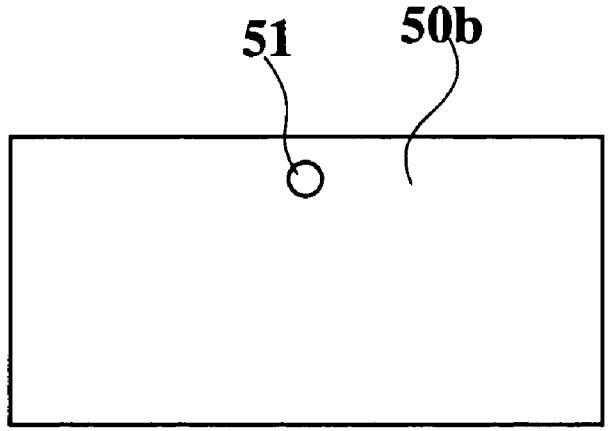

As the commodity display 50, two types of commodity displays are prepared as shown in FIGS. 8(A) and 8(B), although it is not limited thereto. The first one is a deep commodity display 50*a*, and the second one is a shallow commodity display 50*b*. The commodity display 50 can fit into the frame 20 from the front.

Also, a key cylinder 51 is provided on the front surface of the commodity display 50. A projecting piece which is not shown is projected by inserting a key which is not shown into the key cylinder 51 and turning it. When the projecting piece is in a projecting state, it engages with a hole of the frame 20 which is not shown, thereby fixing the commodity display 50 to the frame 20 or the like.

7. Configuration of Cover 60

The cover 60 is for covering the commodity supply opening 20*a* of the frame 20 at the highest stage, and is attached to the frame 20 with a screw or the like.

8. Combination

By arbitrarily combining the above capsule commodity dispensing machine 10, the frame 20, the base 30, the commodity storing box 40, the commodity display 50 and the cover 60, the capsule commodity dispensing device 100 is freely configured.

9. Modified Example

The embodiment of the present invention is explained above, however, the present invention is not limited to the embodiment, and it is needless to say that various modifications thereof may be made in a scope of not changing the subject matter of the invention.

Figure 9:
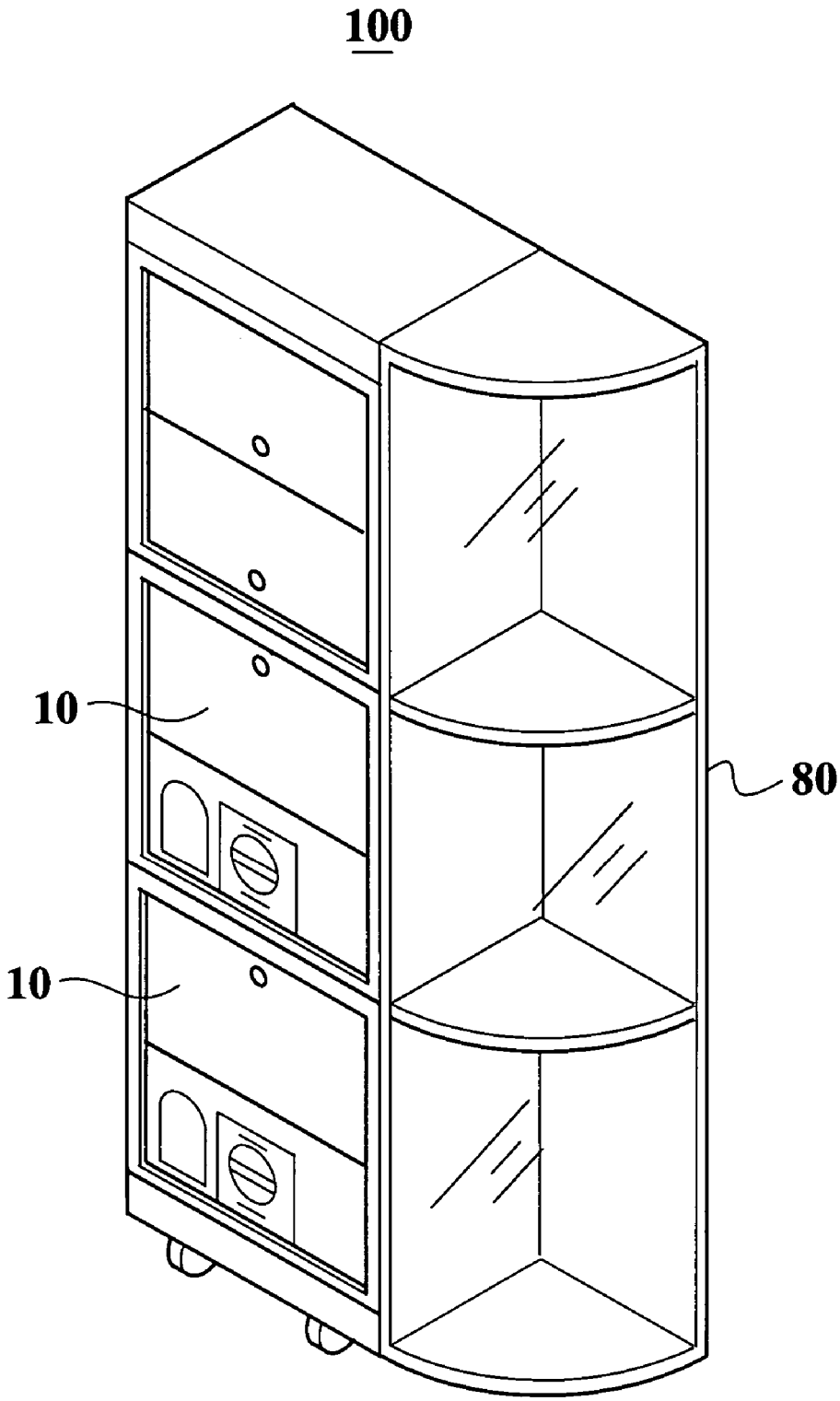
FIG. 9 is a perspective view for explaining a modified example of the capsule commodity dispensing device in FIG. 1.
Figure 10:
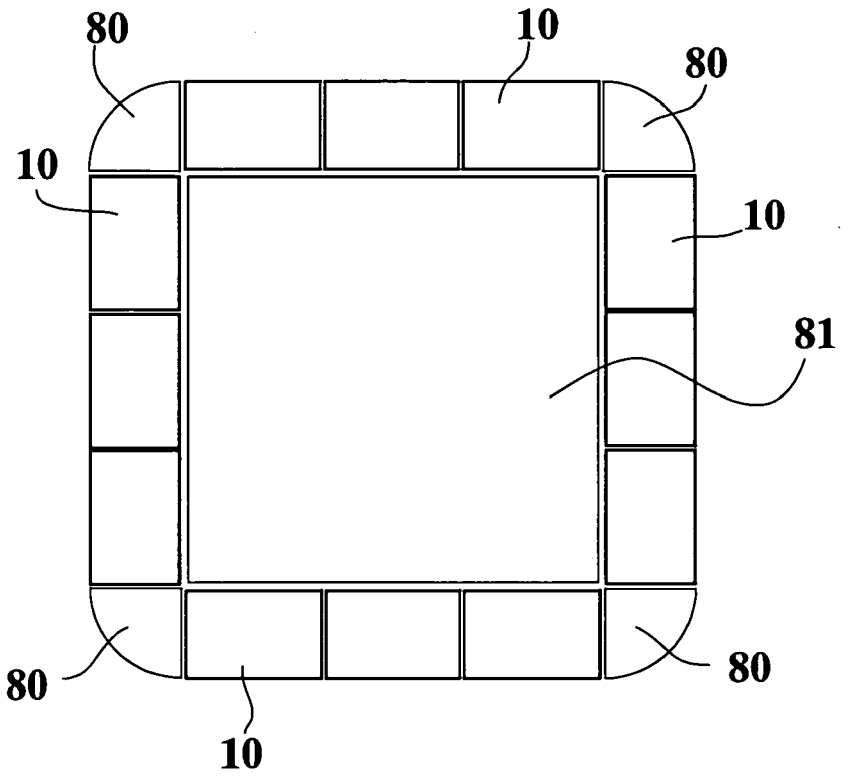
FIG. 10 is a plan view showing one modified example of the capsule commodity dispensing device in FIG. 1.
Figure 11:
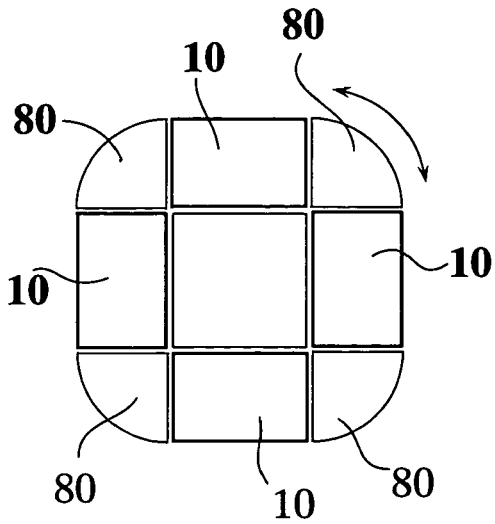
FIG. 11 is a plan view showing another modified example of the capsule commodity dispensing device in FIG. 1.

For example, by combining with corner displays 80 shown in FIG. 9, the capsule commodity dispensing machines 10 may be arranged around a column 81 to configure the commodity dispensing device 100 as shown in FIG. 10, or the commodity dispensing device 100 may be configured as shown in FIG. 11 so that the entire commodity dispensing device 100 is placed on the rotating table (not shown) to make the entire commodity dispensing device 100 rotatable.

In the above modification, the clean box is provided on the base, however, the clean box may be provided on the frame.

Second Embodiment

1. Whole Configuration of Capsule Commodity Dispensing Device

Figure 12:
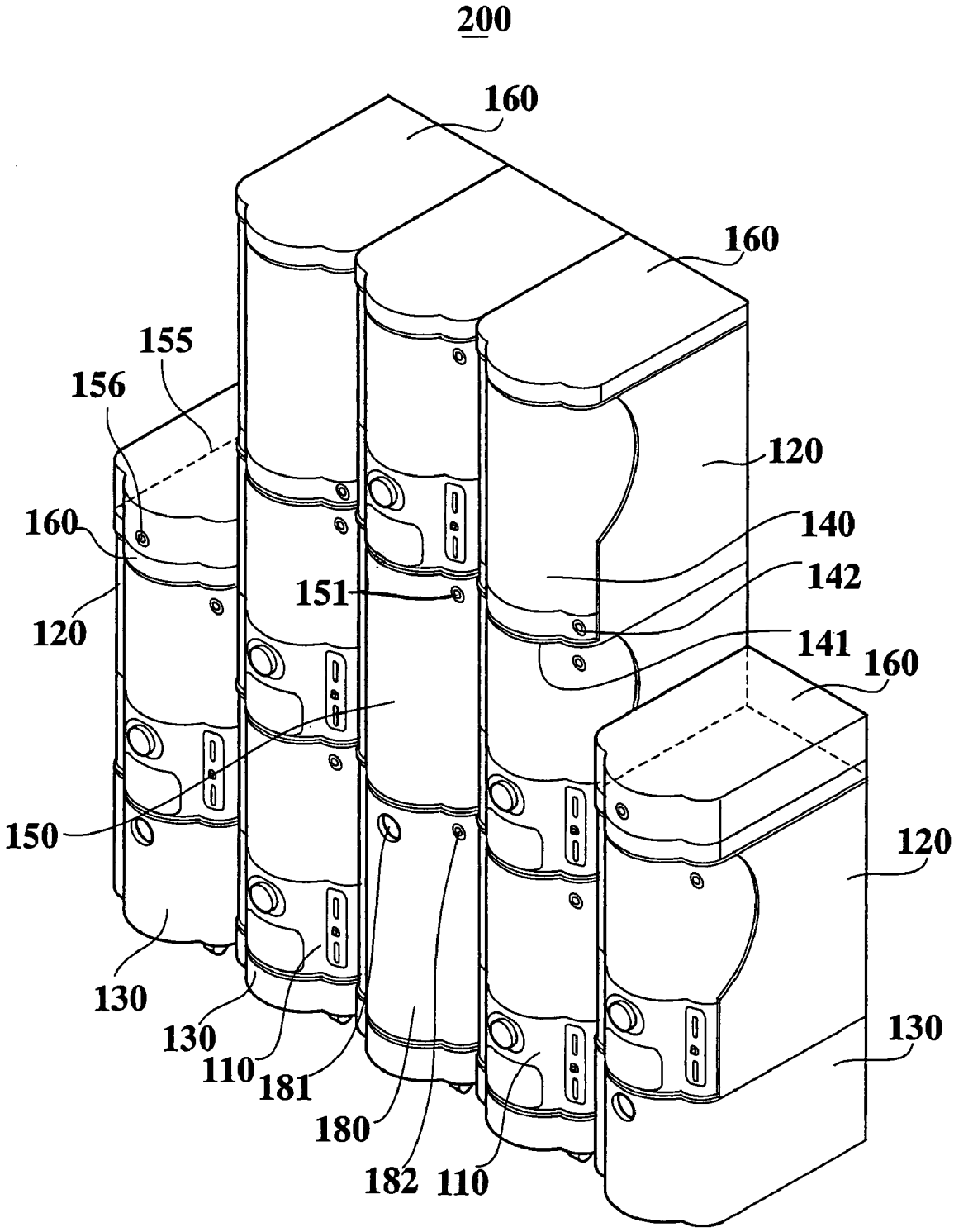
FIG. 12 is a perspective view of a capsule commodity dispensing device according to the second embodiment.

The capsule commodity dispensing device 200 of the embodiment, which is one of the packaged commodity devices, comprises a capsule commodity dispensing machine 110, a frame 120, a base 130, a commodity storing box 140, a commodity display 150 and a cover 160 as shown in FIG. 12.

2. Configuration of Capsule Commodity Dispensing Machine

Figure 13:
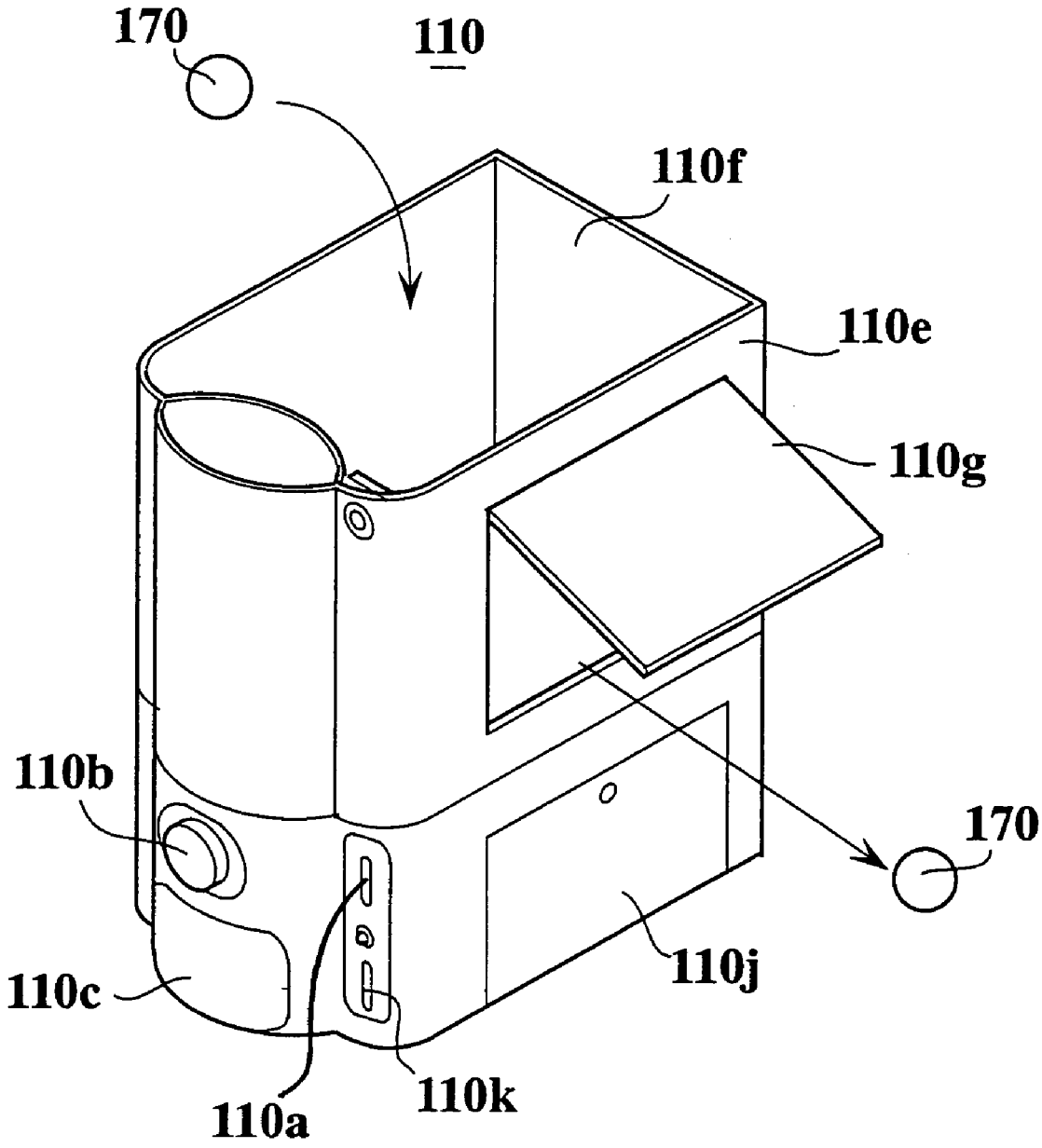
FIG. 13 is a perspective view of a capsule commodity dispensing machine in the capsule commodity dispensing device in FIG. 12.
Figure 14:
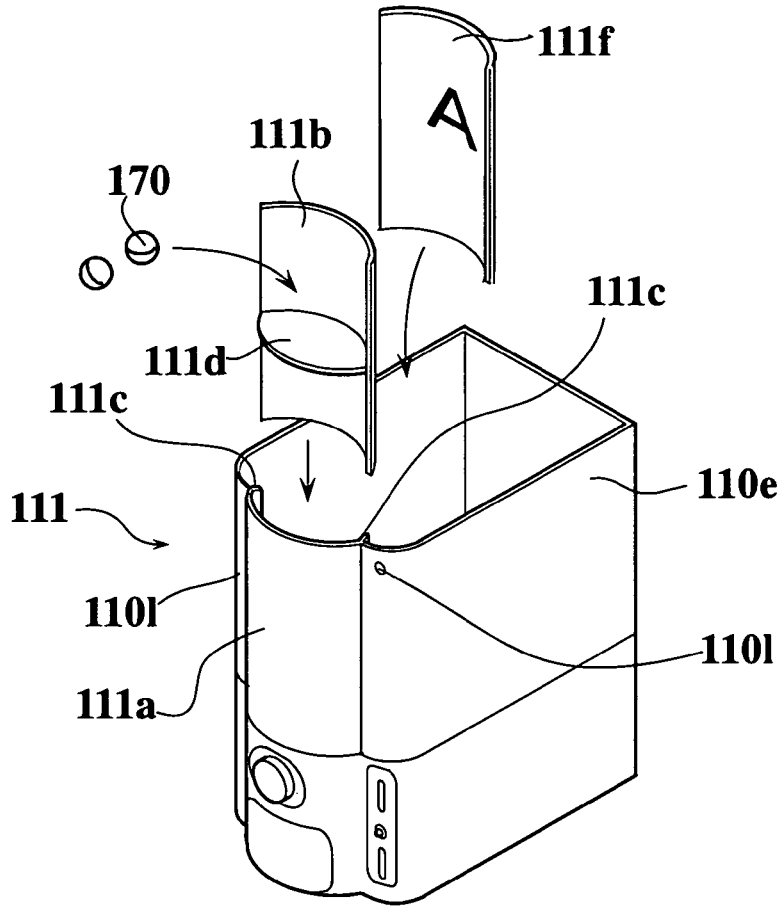
Figure 14:
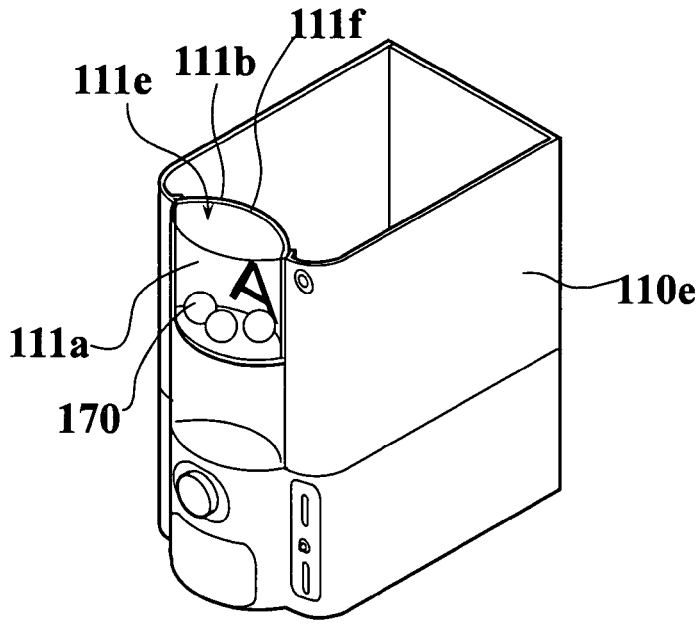

The capsule commodity dispensing machine 110 is formed into a box shape as shown in FIG. 13. However, it is not limited to the box shape. This capsule commodity dispensing machine 110 is configured such that a capsule commodity 170 stored in a case body 110*e* is dispensed from a commodity dispense opening 110*c* by a customer turning a handle 110*b* after inserting a coin into a coin slot 110*a* on the front surface. Here, a coin is inserted into the coin slot 110*a*, however, the configuration may be such that a deposit card, a cash card or a credit card is inserted.

In the case body 110*e* forming the upper structure of the capsule commodity dispensing machine 110, many capsule commodities 170 can be received. When the capsule of the capsule commodity 170 is opened, there is a figure or other toy therein.

The capsule commodities 170 are supplied into the case body 110*e* from a commodity supply opening 110*f* provided in the upper surface of the case body 110*e*. On the other hand, removal of the capsule commodities 170 are performed by opening a door 110*g* provided on the side surface of the case body 110*e*.

The case body 110*e* is formed with a transparent material, corners at which a front wall meets side walls are formed into a curved surface 1101, and a display portion 111 is formed at a center portion of the front wall.

The display portion 111, as shown in FIGS. 14 to 18, comprises an arch shaped wall portion 111*a* which protrudes forward from the front wall of the case body 110*e*, and a partition plate 111*b*. The partition plate 111*b* is formed into an arch shape with a radius of curvature slightly smaller than that of the arch shaped wall portion 111*a*. Protruding pieces 111*c* having a radius of curvature the same as that of the arch shaped wall portion 111*a* are provided inward at both end portions of the arch shaped wall portion 111*a*. On the other hand, a shelf 111*d* is disposed at approximately the midpoint in a height direction of the partition plate 111*b*. The shelf is formed into an approximately elliptical shape, and the outline of a portion projecting from the partition plate 111*b* is formed into an approximately arch shape having a radius of curvature same as that of the partition plate 111*b*.

In the display portion 111 configured as above, as shown in FIG. 14(A), the partition plate 111*b* is fit between the protruding pieces 111*c*, 111*c* from above to project inward of the case body 110*e*. As shown in FIG. 14(B), the capsule commodities 170 as a sample are stored in a space 111*e* which is composed of the partition plate 111*b*, the shelf 111*d* and the arch shaped wall portion 111*a* of the case body 110*e*.

Figure 15:
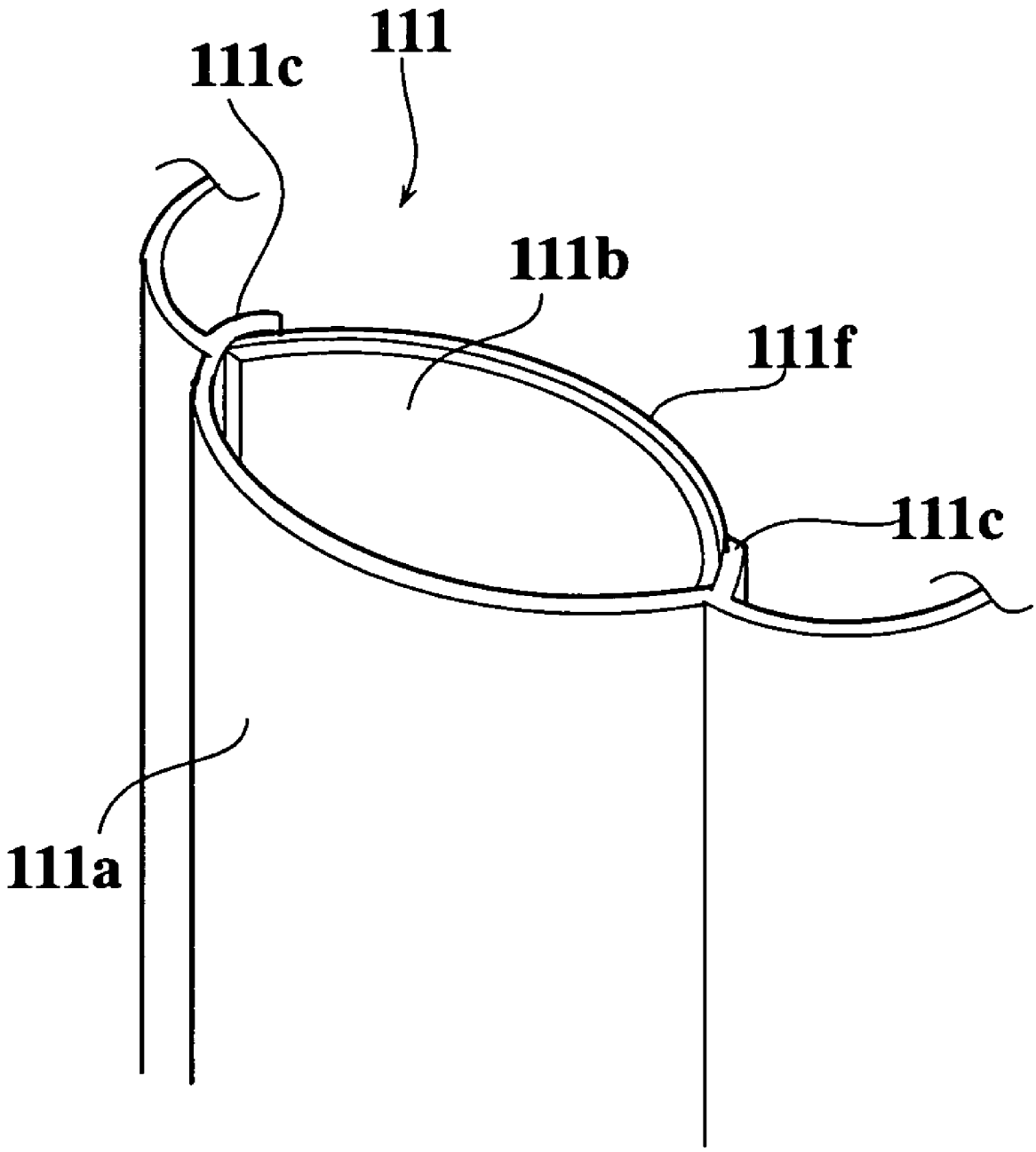
FIG. 15 is an expanded perspective view of a main portion of the capsule commodity dispensing device in FIG. 14.
Figure 16:
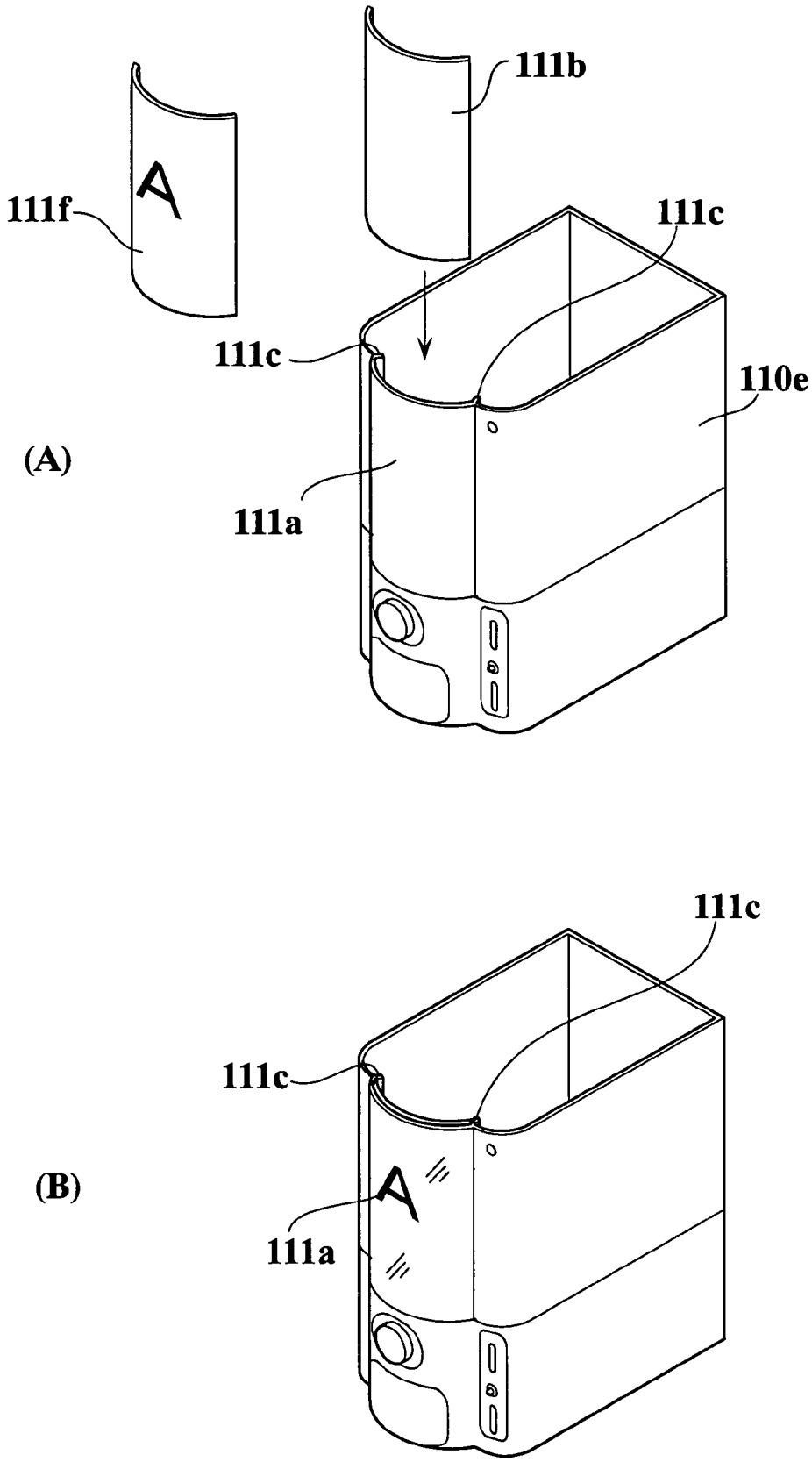
Figure 17:
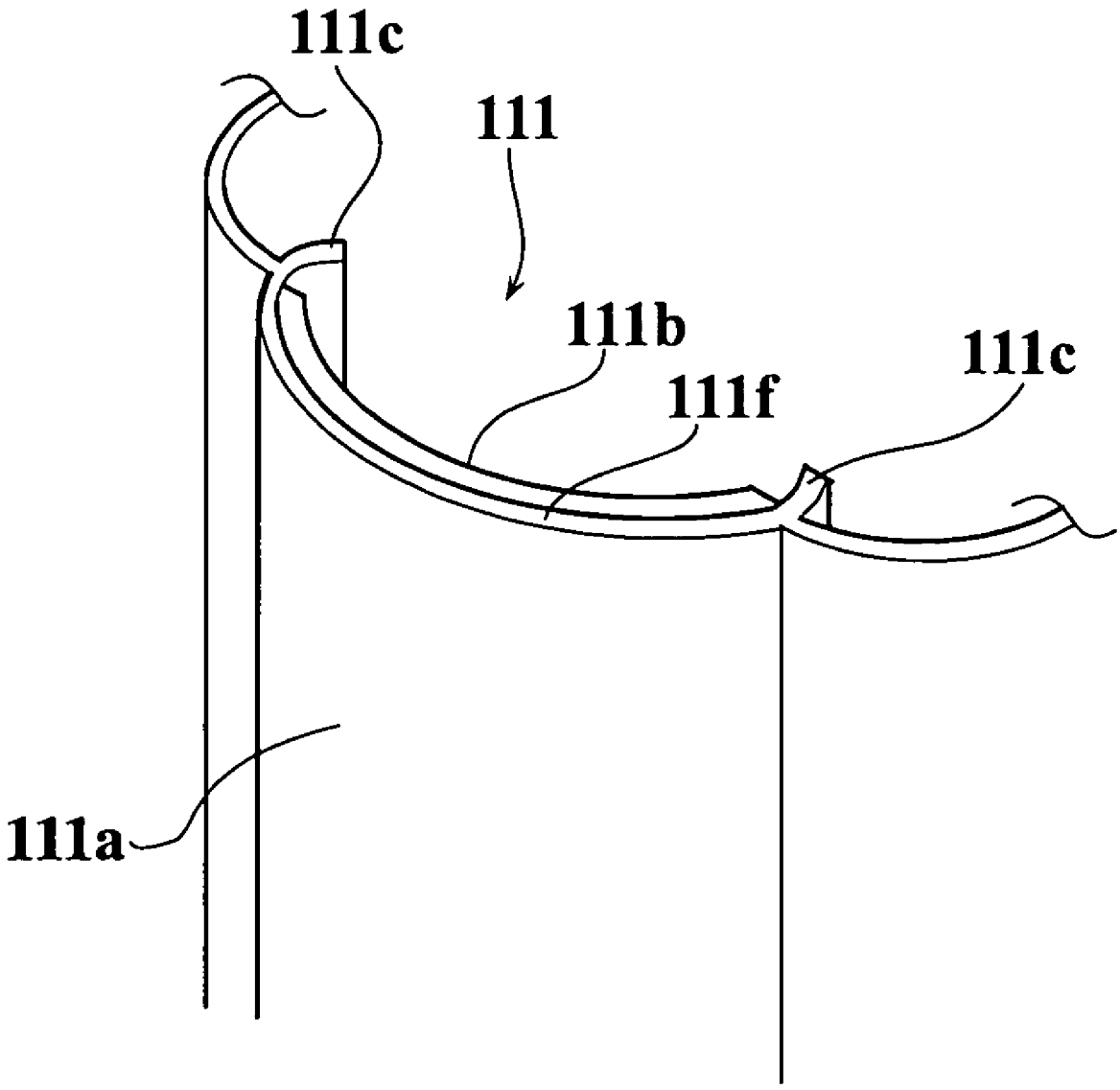
FIG. 17 is an expanded perspective view of a main portion of the capsule commodity dispensing device in FIG. 16.

Also, in this display portion 111, by utilizing the space between the arch shaped wall portion 111*a* or the protruding pieces 111*c* of the case body 111*e* and the partition plate 111*b*, a display member 111*f* is attached. As one attachment mode, as shown in FIG. 14(A), the display member 111*f* is moved along the protruding side surface of the partition plate 111*b* to position the display member 111*f* inward of the partition plate 111*b*, so that the display member 111*f* is fit between the protruding pieces 111*c*, 111*c* from above together with the partition plate 111*b*. In this case, both side edges of the display member 111*f* are, as shown in FIG. 15, sandwiched and held by the both side edges of the protruding pieces 111*c* and the partition plate 111*b*. As another attachment mode of the display member 111*f*, as shown in FIG. 16(A), the display member 111*f* is moved along the protruding side surface of the partition plate 111*b* to position the display member 111*f* outward of the partition plate 111*b*, so that the display member 111*f* is fit between the protruding pieces 111*c*, 111*c* along the inner surface of the arch shaped wall portion 111*a* from above together with the partition plate 111*b*. In this case, as shown in FIG. 17, approximately the entire display member 111*f* is sandwiched and held by the arch shaped wall portion 111*a* and the partition plate 111*b*.

Figure 18:
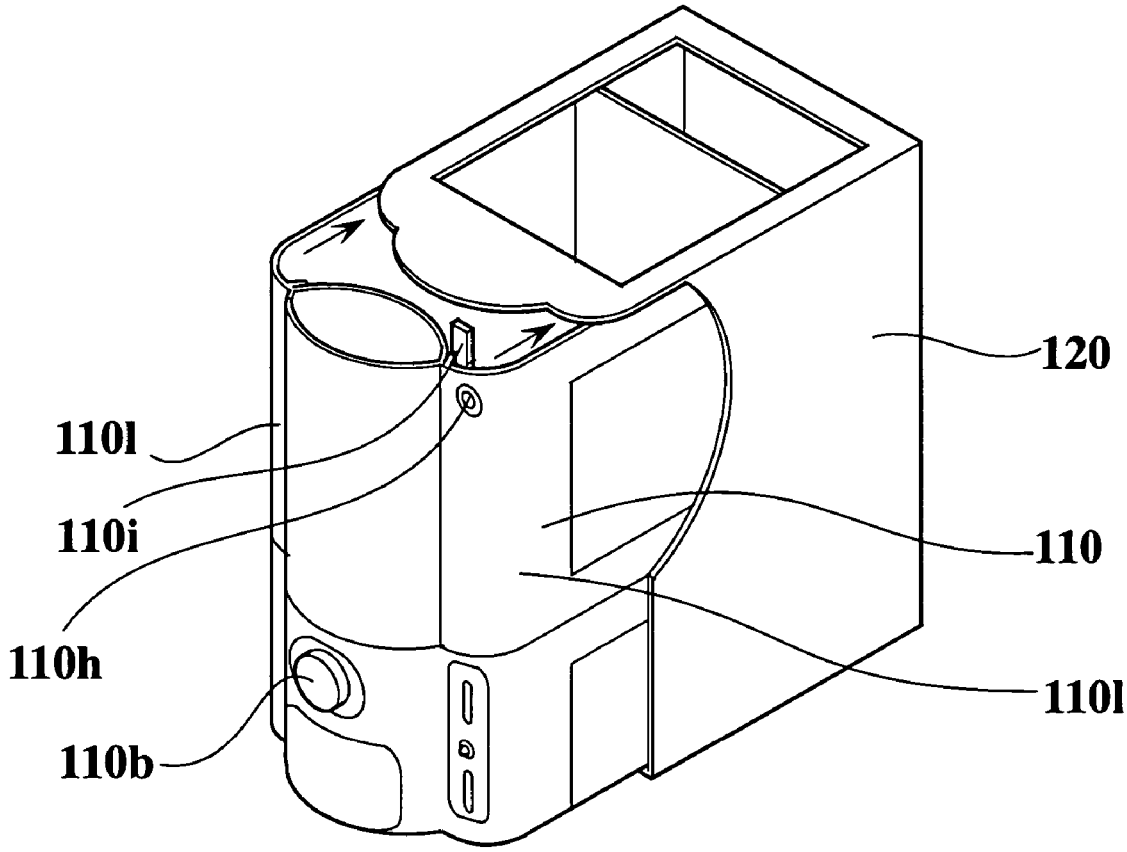
FIG. 18 is a perspective view of the capsule commodity dispensing machine and a frame in the capsule commodity dispensing device in FIG. 12.

Also, as shown in FIG. 18, a key cylinder 110*h* is provided on the front surface of the case body 110*e*. A projecting piece 110*i* is projected by inserting a key which is not shown into the key cylinder 51 and turning it. When the projecting piece 110*i* is in a projecting state, it engages with a hole of the frame 120 which is not shown, thereby fixing the capsule commodity dispensing machine 110 to the frame 120.

A mechanical portion forming the lower structure of the capsule commodity dispensing machine 110 is provided with a coin sorting device, a rotation drum which rotates with the rotation of the handle 10*b* or the like, although they are not shown.

As shown in FIG. 13, the mechanical portion is provided with a cash box 110*j* on the side portion and a coin return 110*k* on the front surface.

3. Configuration of Frame 120

Figure 19:
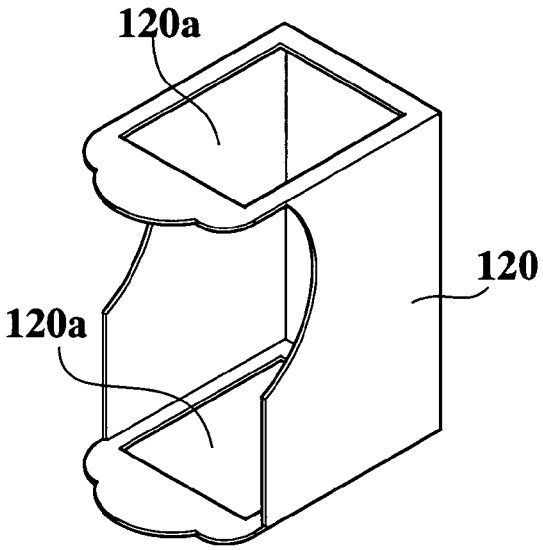
FIG. 19 is a perspective view of the frame in the capsule commodity dispensing device in FIG. 12.
Figure 20:
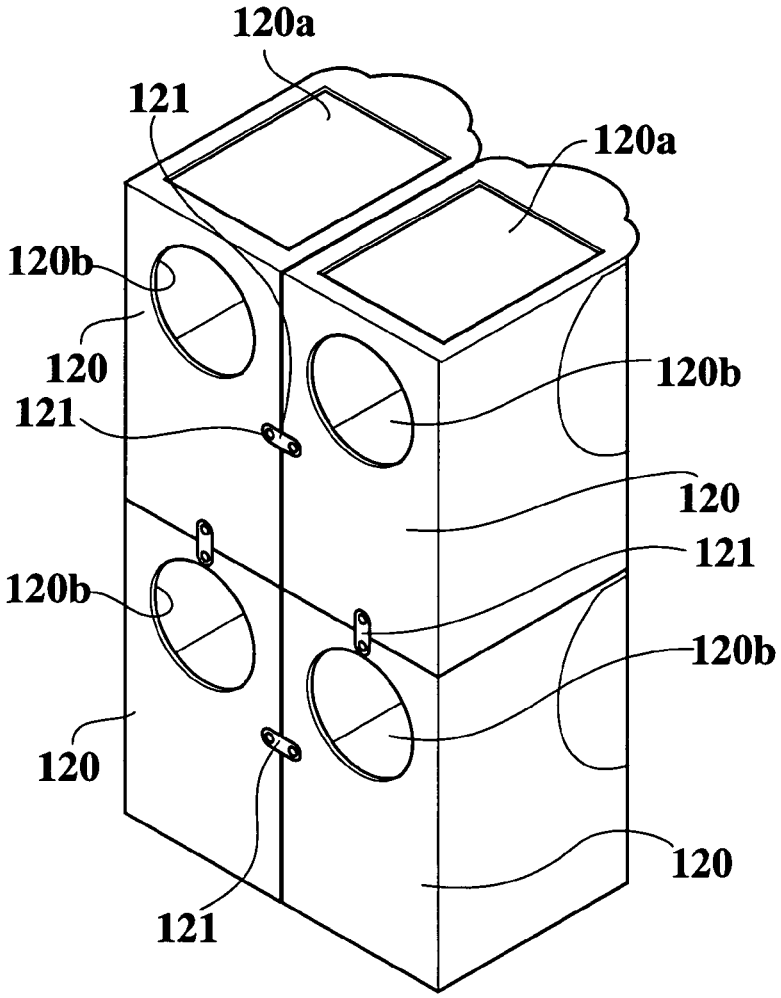
FIG. 20 is a view showing a connection structure of the frames in the capsule commodity dispensing device in FIG. 12.

The frame 120 is formed into a box shape, although it is not specifically limited. The capsule commodity dispensing machine 110 can fit into the frame 120 from a front of the frame. The frame 120 is configured such that the capsule commodity dispensing machine 110 can be covered excluding the front surface and the corner portions 1101 of the capsule commodity dispensing machine 110. In the upper surface and the lower surface of the frame 120, as shown in FIG. 19, commodity supply openings 120*a* are formed to correspond to the commodity supply opening 110*f* of the capsule commodity dispensing machine 110. An inspection hole 120*b* is formed in the rear surface of the frame 120.

The frames 120 can be piled in the upper and lower direction, and can be arranged in parallel in a lateral direction. Fixation of the adjacent frames is performed by using a connection plate 121 to cross over between the frames 120 on the rear surface side and be screwed shut, although it is not specifically limited thereto.

4. Configuration of Base 130

Figure 21:
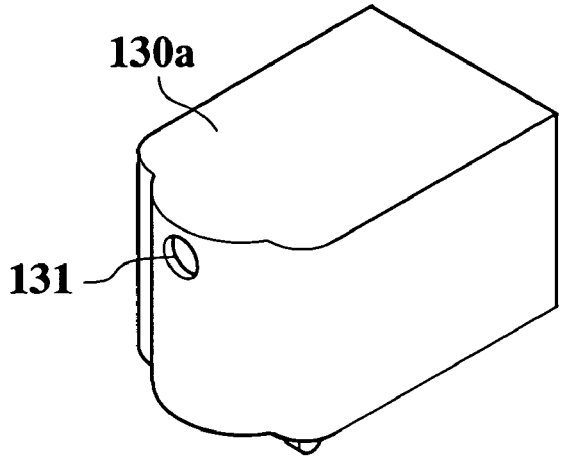
Figure 21:
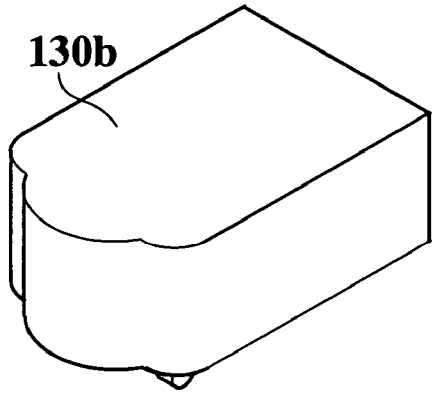
Figure 21:
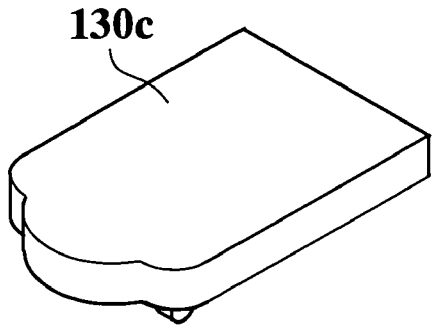

As the base 130 on which the frame 120 is set, three types of bases with a caster are prepared, although it is not specifically limited thereto. The first one is a base 130*a* with a clean box (FIG. 21(A), the second one is a standard base 130*b* (FIG. 21(B), and the third one is a slim base 130*c* (FIG. 21(C). Among them, the base 130*a* with the clean box is for putting unnecessary capsules, and comprises a capsule slot 131. The capsules which were put in can be taken out from a door which is not shown.

The connection structure of the base 130 and the frame 120 is the same as the connection structure of the frames 120, although it is not specifically limited thereto.

5. Configuration of Commodity Storing Box 140

The commodity storing box 140 can fit into the frame 120 from the front of the frame. A bottom plate 141 of the commodity storing box 140 can be inserted and removed from the front. Accordingly, when the commodity storing box 140 is fit into the frame 120 in a state of storing the capsule commodities into the commodity storing box 140 and the bottom plate 141 is removed, the capsule commodities 170 are supplied into the capsule commodity dispensing machine 110 through the commodity supply openings 110*f*, 120*a*.

Further, a key cylinder 142 is provided on the front surface of the commodity storing box 140. A projecting piece which is not shown is projected by inserting a key which is not shown into the key cylinder 142 and turning it. When the projecting piece is in a projecting state, it engages with a hole of the frame 120 which is not shown, thereby fixing the commodity storing box 140 to the frame 120 or the like. It is preferable to provide the key cylinder 142 of the commodity storing box 140 on the lower side of the commodity storing box 140 so that the bottom plate 141 is also fixed by the projecting piece at the same time.

6. Configuration of Commodity Display 150 and Small Display 155

The commodity display 150 can fit into the frame 120 from the front of the frame. As shown in FIG. 12, a key cylinder 151 is provided on the front surface of the commodity display 150. A projecting piece which is not shown is projected by inserting a key which is not shown into the key cylinder 151 and turning it. When the projecting piece is in a projecting state, it engages with a hole of the frame 120 which is not shown, thereby fixing the commodity display 150 to the frame 120 or the like.

The small display 155 is attachable to the frame 120 or the cover 160 to be described later. In the small display 155, a projecting piece which is not shown is projected by inserting a key which is not shown into a key cylinder 156 and turning it. When the projecting piece is in a projecting state, it engages with a hole of the frame 120 or the cover 160 which is not shown, thereby fixing the small display 155 to the frame 120, the cover 160 or the like.

7. Configuration of Cover 160

The cover 60 is for covering the commodity supply opening 120*a* of the frame 120 at the highest stage, and is attached to the frame 120 with a screw or the like.

8. Configuration of Clean Box 180

The clean box 18 is for putting unnecessary capsules, and comprises a capsule slot 181. The capsules which were put in can be collected by opening the clean box 180. This clean box 180 can be replaced with the capsule commodity dispensing machine 110 or the commodity display 150. Here, in the clean box 180, a projecting piece which is not shown is projected by inserting a key which is not shown into the key cylinder 182 and turning it. When the projecting piece is in a projecting state, it engages with a hole of the frame 120 which is not shown, thereby fixing the clean box 180 to the frame 120 or the like.

9. Combination

By arbitrarily combining the above capsule commodity dispensing machine 110, the frame 120, the base 130, the commodity storing box 140, the commodity display 150, the small display 155, the cover 160 and the clean box 180, the capsule commodity dispensing device 200 is freely configured.

INDUSTRIAL APPLICATION

As described above, the packaged commodity dispensing device according to the present invention is effective to provide a point of sale with a large scale at a small space, and is especially suitable for arranging packaged commodity dispensing machines with multiple stages in a height direction.

The invention claimed is:

1. A packaged commodity dispensing device comprising:

a packaged commodity dispensing machine to dispense a packaged commodity;

a first frame having a first inlet and a first inner space, wherein the packaged commodity dispensing machine is detachably movable through the first inlet into a first position in the first inner space;

a member to removably engage the packaged commodity dispensing machine with the first frame, when the packaged commodity dispensing machine is in the first position, wherein the packaged commodity dispensing machine has an upper surface in which a first commodity supply opening is formed, and the first frame has an upper surface in which a second commodity supply opening is formed, the first commodity supply opening and the second commodity supply opening being in communication with each other when the machine is in the first position; and a commodity storing box having a bottom with an opening, which box is located above the upper surface of the first frame, and a plate which is provided at the bottom of the commodity storing box and is inserted in and withdrawn from the bottom of the commodity storing box, wherein a commodity inside the commodity storing box is supplied to the packaged commodity dispensing machine via the opening in the commodity storing box, the first commodity supply opening and the second commodity supply opening, when the bottom plate is withdrawn from the bottom of the commodity storing box.

2. A packaged commodity dispensing device comprising:

a packaged commodity dispensing machine to dispense a packaged commodity;

a first frame having a first inlet and a first inner space, wherein the packaged commodity dispensing machine is detachably movable through the first inlet into a first position in the first inner space;

a member to removably engage the packaged commodity dispensing machine with the first frame, when the packaged commodity dispensing machine is in the first position, wherein the packaged commodity dispensing machine has an upper surface in which a first commodity supply opening is formed, and the first frame has an upper surface in which a second commodity supply opening is formed, the first commodity supply opening and the second commodity supply opening being in communication with each other when the machine is in the first position; and a second frame having a second inlet and a second inner space, which second frame is detachably fixed on the upper surface of the first frame; and a commodity storing box having a bottom with an opening, which box is received in the second inner space through the second inlet of the second frame; and a bottom plate which is provided at the bottom of the commodity storing box and is inserted in and withdrawn from the bottom of the commodity storing box, wherein a commodity inside the commodity storing box is supplied to the packaged commodity dispensing machine via the opening in the commodity storing box, the first commodity supply opening and the second commodity supply opening, when the bottom plate is withdrawn from the bottom of the commodity storing box.

3. The packaged commodity dispensing device as claimed in claim 2, further comprising a third frame having a third inlet and a third inner space, which third frame is detachably fixed on the upper surface of the first frame; and a commodity display which is received in the third inner space through the third inlet of the third frame.

4. A packaged commodity dispensing device comprising:

a packaged commodity dispensing machine to dispense a packaged commodity;

a first frame having a first inlet and a first inner space, wherein the packaged commodity dispensing machine is detachably movable through the first inlet into a first position in the first inner space; and a member to removably engage the packaged commodity dispensing machine with the first frame, when the packaged commodity dispensing machine is in the first position, wherein at least a front wall of the packaged commodity dispensing machine is formed with a transparent material, and an arch shaped wall portion is formed at a central portion of the front wall in a width direction to protrude forward, and wherein protruding pieces are formed inward at both ends of the arch shaped wall portion of the packaged commodity dispensing machine, and a partition plate which removably fits between joint portions of the protruding portions and the arch shaped wall portion is provided.

5. The packaged commodity dispensing device as claimed in claim 4, wherein the partition plate is formed into a shape following an inner surface of the arch shaped wall portion.

6. The packaged commodity dispensing device as claimed in claim 5, further comprising a display member which is inserted between the partition plate and the arch shape wall portion.

7. The packaged commodity dispensing device as claimed in claim 4, further comprising a shelf at a middle portion in a height direction of the partition plate.

* * * * *

UNITED STATES PATENT AND TRADEMARK OFFICE

CERTIFICATE OF CORRECTION

PATENT NO. : 7,172,094 B2
APPLICATION NO. : 10/517654
DATED : February 6, 2007
INVENTOR(S) : Junicha Atsuta It is certified that error appears in the above-identified patent and that said Letters Patent is hereby corrected as shown below:

On the Title page (73)
Please change the Assignee from TOMY COMPANY, LTD. to YUJIN COMPANY, LTD.

Signed and Sealed this

Twenty-sixth Day of August, 2008

JON W. DUDAS
*Director of the United States Patent and Trademark Office*